US009999888B2

(12) United States Patent
Ziegler et al.

(10) Patent No.: US 9,999,888 B2
(45) Date of Patent: Jun. 19, 2018

(54) SPECIMEN CONTAINER FOR URINE AND OTHER LIQUIDS

(71) Applicant: INTEGRATED LAB SOLUTIONS, INC., Southlake, TX (US)

(72) Inventors: Robert Ziegler, Southlake, TX (US); Alex Stefanowicz, Ocean Ridge, FL (US)

(73) Assignee: INTEGRATED LAB SOLUTIONS, INC., Southlake, TX (US)

( * ) Notice: Subject to any disclaimer, the term of this patent is extended or adjusted under 35 U.S.C. 154(b) by 49 days.

(21) Appl. No.: 15/159,745

(22) Filed: May 19, 2016

(65) Prior Publication Data

US 2017/0333893 A1 Nov. 23, 2017

(51) Int. Cl.

*B01L 3/00* (2006.01)
*B65D 43/02* (2006.01)
*B65D 51/00* (2006.01)

(52) U.S. Cl.

CPC ..... *B01L 3/508* (2013.01); *B65D 43/0225* (2013.01); *B65D 51/002* (2013.01); *B01L 2200/12* (2013.01); *B01L 2300/042* (2013.01); *B01L 2300/044* (2013.01); *B01L 2300/0832* (2013.01)

(58) Field of Classification Search

CPC ..... B01L 2200/12; B01L 2300/042; B01L 2300/044; B01L 2300/0832; B01L 3/508; B65D 43/0225; B65D 51/002

See application file for complete search history.

(56) References Cited

U.S. PATENT DOCUMENTS 5,202,093 A * 4/1993 Cloyd ..... B01L 3/50825 215/247
5,271,531 A * 12/1993 Rohr ..... B65D 47/0833 215/232
5,647,939 A * 7/1997 Gee ..... B29C 66/02 156/272.6
5,897,840 A 4/1999 Owens, Jr.
6,030,582 A 2/2000 Levy
6,361,744 B1 3/2002 Levy
6,375,022 B1 * 4/2002 Zurcher ..... B65D 41/28 215/232
6,752,965 B2 6/2004 Levy
7,824,921 B1 11/2010 Levy
8,303,914 B2 * 11/2012 Zurcher ..... B01L 3/50825 422/547
8,460,620 B2 * 6/2013 Bartfeld ..... B01L 3/5082 220/737
8,806,920 B2 * 8/2014 Blekher ..... A61B 5/1411 73/53.01
8,862,197 B2 * 10/2014 Kamath ..... A61B 5/14865 600/345

* cited by examiner

*Primary Examiner* — Samuel S Siefke
(74) *Attorney, Agent, or Firm* — Munck Wilson Mandala, LLP

(57) ABSTRACT

A specimen container for urine and other liquids is provided having a container lid, an elastomeric septum, a cup, and a non-porous seal. The elastomeric septum covers a septum hole in the lid, and the non-porous seal is affixed to the lid such that it creates a liquid-tight boundary between the septum and the chamber within the bottle. The septum includes a depressed portion and an area of minimum thickness shaped to allow an implement to pass through the area of minimum thickness. The depressed portion may also include a pre-cut which allows the implement to pass through the septum more easily.

20 Claims, 8 Drawing Sheets

SPECIMEN CONTAINER FOR URINE AND OTHER LIQUIDS

TECHNICAL FIELD

The following disclosure relates generally to the field of medical testing and analysis of liquid specimen samples.

BACKGROUND

Liquid specimen samples, including urine samples, are often used in medical testing procedures. Employers often require prospective employees to submit to drug screenings, which are often carried out by testing samples of the prospective employees' urine. Urine samples are often deposited in small containers including a bottle or cup with a screw-on or snap-on lid. It can be very time-consuming and inefficient for medical technicians to remove urine samples from these containers for testing. A need therefore exists for a specimen container for urine and other liquids that allows more efficient extraction of the liquid specimen.

After receiving the liquid specimen, closed specimen containers may be shipped by ground or air transport to a testing facility. During transport, the containers may be subjected to vibration, shock, and/or changes in external air pressure, which may dislodge the lids and/or cause the contents to leak or spill from the container. A need therefore exists for a specimen container for urine and other liquids having improved resistance to spillage during transport or pressure changes.

SUMMARY

The following disclosure describes and illustrates a container for holding a liquid specimen sample, such as a urine sample. The improvements upon ordinary liquid specimen containers allow the disclosed container to be used in a way that increases ease and efficiency of extracting liquid specimen samples from sample containers.

In one aspect of the disclosure, a specimen container for urine and other liquids is provided, the container comprising a cup, the cup including a cylindrical sidewall with an upper edge and a lower edge, a bottom wall attached to the lower edge, and the upper edge defining an open end; a container lid, the lid including a central portion with a top surface and a bottom surface, the central portion defining a septum hole formed through the top and bottom surfaces, and cylindrical sidewalls; a septum of elastomeric material, the septum having a top surface, a bottom surface, and a depressed portion including an area of minimum thickness, the depressed portion increasing in thickness from the minimum thickness to much thicker elastomeric material, the increase in thickness occurring over a substantial distance along a direction transverse to the thickness, the septum being connected to the container lid so as to completely block the septum hole, the depressed portion and said area of minimum thickness being shaped and configured to elastically distend to pass an implement through a tear in the area of minimum thickness and to be self-reclosing by returning opposite edges of the tear to a substantially contiguous closed condition after withdrawal of the implement; and a non-porous seal affixed to the bottom surface of the central portion and having a top surface and a bottom surface, wherein the seal covers the bottom surface of the septum and creates a liquid-tight boundary between the septum and the bottom surface of the seal; wherein the container lid is adapted to engage the open end of the cup and form a chamber within the cup between the bottom wall and the lid.

In another embodiment, the septum has a pre-cut that extends from the top surface of the septum at least partially through a portion of the area of minimum thickness.

In yet another embodiment, wherein the septum has a pre-cut that extends from the top surface of the septum through a portion of the area of minimum thickness to the bottom surface of the septum.

In still another embodiment, the pre-cut is a Z-cut shaped pre-cut.

In still another embodiment, a witness seal is affixed to both the cup and the lid.

In still another embodiment, the non-porous seal is heat-bonded to the bottom surface of the central portion of the container lid.

In still another embodiment, the non-porous seal comprises a metallic foil.

In another aspect, a container cap for a container for urine and other liquids is provided, the cap comprising a container lid including a central portion with a top surface and a bottom surface, the central portion defining a septum hole formed through the top and bottom surfaces, and cylindrical sidewalls; an elastomeric septum, the septum having a top surface, a bottom surface, and a depressed portion including an area of minimum thickness, the depressed portion increasing in thickness from the minimum thickness to much thicker elastomeric material, the increase in thickness occurring over a substantial distance along a direction transverse to the thickness, the septum being connected to the container lid so as to completely block the septum hole, the depressed portion and said area of minimum thickness being shaped and configured to elastically distend to pass an implement through a tear in the area of minimum thickness and to be self-reclosing by returning opposite edges of the tear to a substantially contiguous closed condition after withdrawal of the implement; and a non-porous seal, having a top surface and a bottom surface, affixed to the bottom surface of the central portion of the lid, wherein the seal covers the bottom surface of the septum and creates a liquid-tight boundary between the septum and the bottom surface of the seal; wherein the lid is adapted to engage an open end of a container cup and to form a chamber within the cup.

In another embodiment, the septum has a pre-cut that extends from the top surface of the septum at least partially through a portion of the area of minimum thickness.

In yet another embodiment, the septum has a pre-cut that extends from the top surface of the septum through a portion of the area of minimum thickness to the bottom surface of the septum.

In still another embodiment, the non-porous seal comprises a metallic foil.

In still another embodiment, the pre-cut is a Z-cut shaped pre-cut.

In another aspect, a method is provided for producing a container cap for urine and other liquids, the method comprising fabricating a container lid, the lid including a central portion with a top surface and a bottom surface, the central portion defining a septum hole formed through the top and bottom surfaces, and cylindrical sidewalls; fabricating a septum of elastomeric material, the septum having a top surface, a bottom surface, and a depressed portion including an area of minimum thickness, the depressed portion increasing in thickness from the minimum thickness to much thicker elastomeric material, the increase in thickness occurring over a substantial distance along a direction transverse to the thickness, the depressed portion and the area of minimum thickness being shaped and configured to elastically distend to pass an implement through a tear in the area of minimum thickness and to be self-reclosing by returning opposite edges of the tear to a substantially contiguous closed condition after withdrawal of the implement; fabricating a non-porous seal; positioning the septum so that the septum completely blocks the septum hole; and affixing the non-porous seal to the bottom surface of the central portion of the container lid so that the seal completely covers the bottom surface of the septum.

In another embodiment, the step of affixing the non-porous seal includes heat-bonding the non-porous seal to the bottom surface of the central portion of the container lid.

In another embodiment, the step of affixing the non-porous seal includes affixing the non-porous seal to the bottom surface of the central portion of the container lid with a chemical adhesive.

In yet another embodiment, the step of fabricating a container lid includes positioning the septum in an area defining the septum hole and injection-molding the container lid around the septum such that injection-molding the container lid positions the septum so that the septum completely blocks the septum hole.

In still another embodiment, the step of fabricating a septum includes molding the septum within the septum hole such that molding the septum positions the septum so that the septum completely blocks the septum hole.

In still another embodiment, the method further comprises the step of creating, after fabricating the septum, a pre-cut in the septum that extends from the top surface of the septum at least partially through a portion of the area of minimum thickness.

In still another embodiment, step of creating a pre-cut in the septum includes creating a Z-cut shaped pre-cut.

In still another embodiment, the method further comprises the step of exposing the container lid, the septum, and the non-porous seal to gamma radiation.

BRIEF DESCRIPTION OF THE DRAWINGS

For a more complete understanding, reference is now made to the following description taken in conjunction with the accompanying Drawings in which.

DETAILED DESCRIPTION

Figure 1:
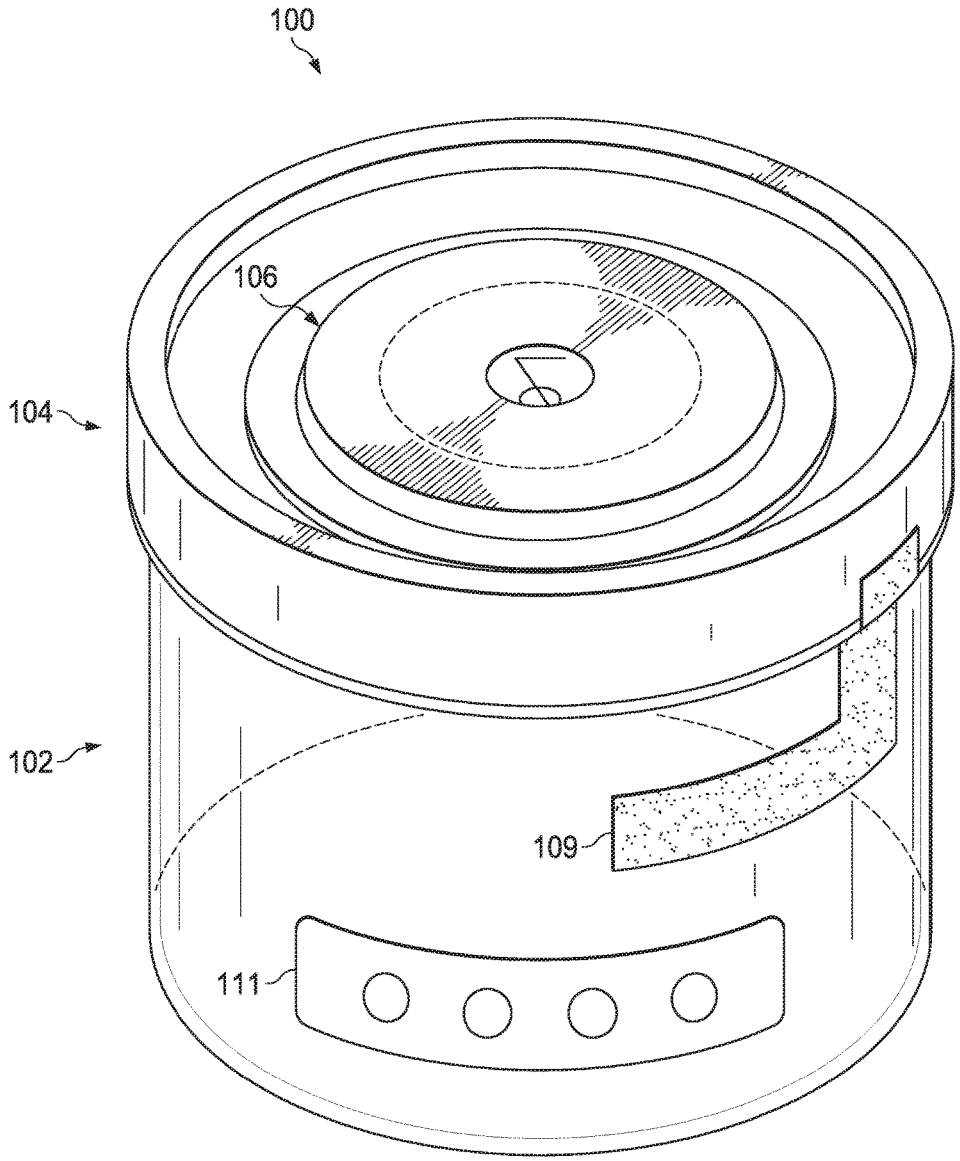
FIG. 1 is a perspective view of a container in accordance with one aspect.

Referring now to the drawings, wherein like reference numbers are used herein to designate like elements throughout, the various views and embodiments of the urine specimen bottle are illustrated and described, and other possible embodiments are described. The figures are not necessarily drawn to scale, and in some instances the drawings have been exaggerated and/or simplified in places for illustrative purposes only. One of ordinary skill in the art will appreciate the many possible applications and variations based on the following examples of possible embodiments.

Figure 3A:
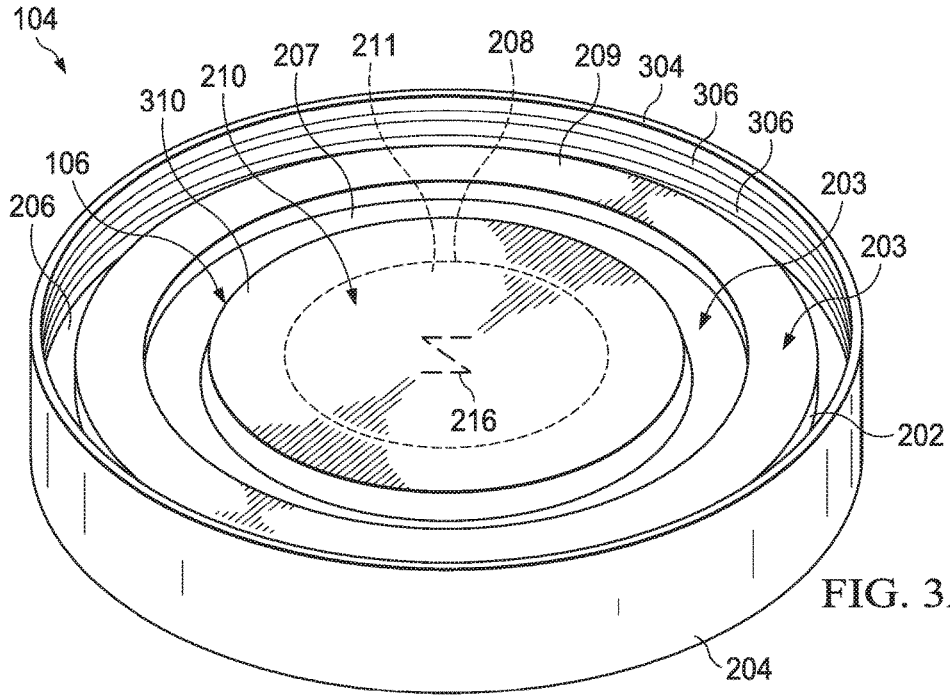
FIG. 3A is a bottom perspective view of the container of FIG. 1 with certain elements removed for purposes of illustration.
Figure 3B:
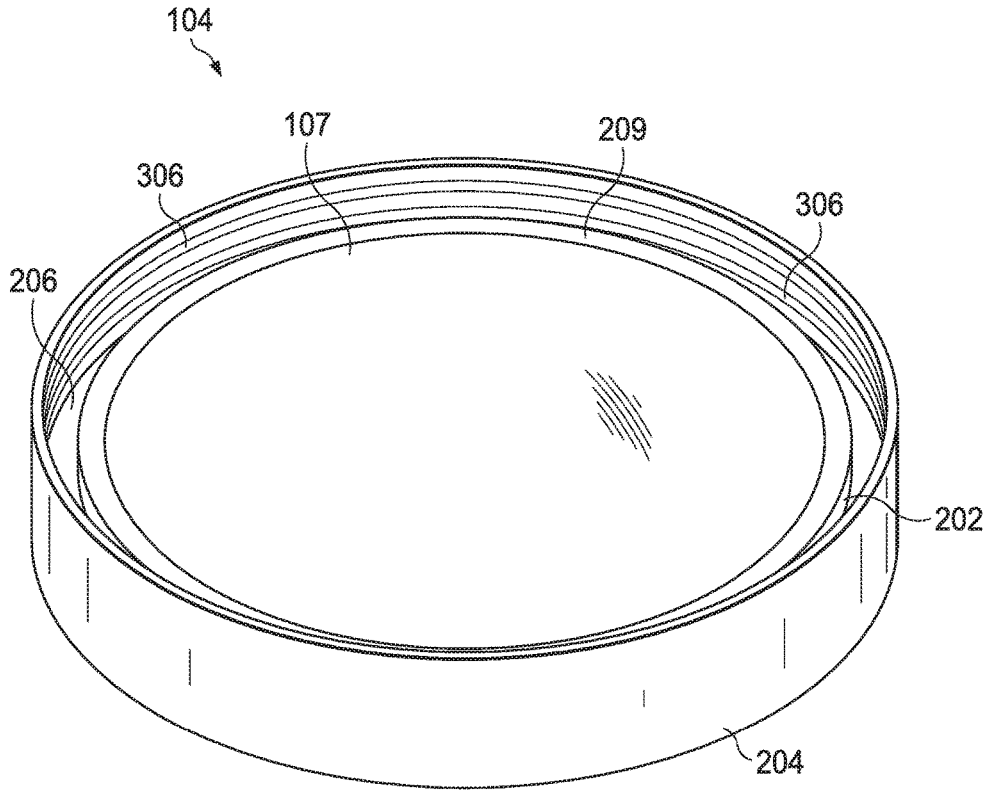
FIG. 3B is a bottom view of the lid with a non-porous seal affixed to the lid.

Turning to FIG. 1, there is illustrated a liquid specimen container 100, comprising a cup 102, a container lid 104, an elastomeric septum 106, and a non-porous seal 107 (shown in FIG. 3B). The cup 102 also has affixed to it a witness seal 109, which is also affixed to the lid 104, and a temperature indicator label 111. When the lid 104 is engaged with the cup 102, a chamber is formed within the cup 102 between the lid 104 and the bottom wall of the cup 102.

Figure 2:
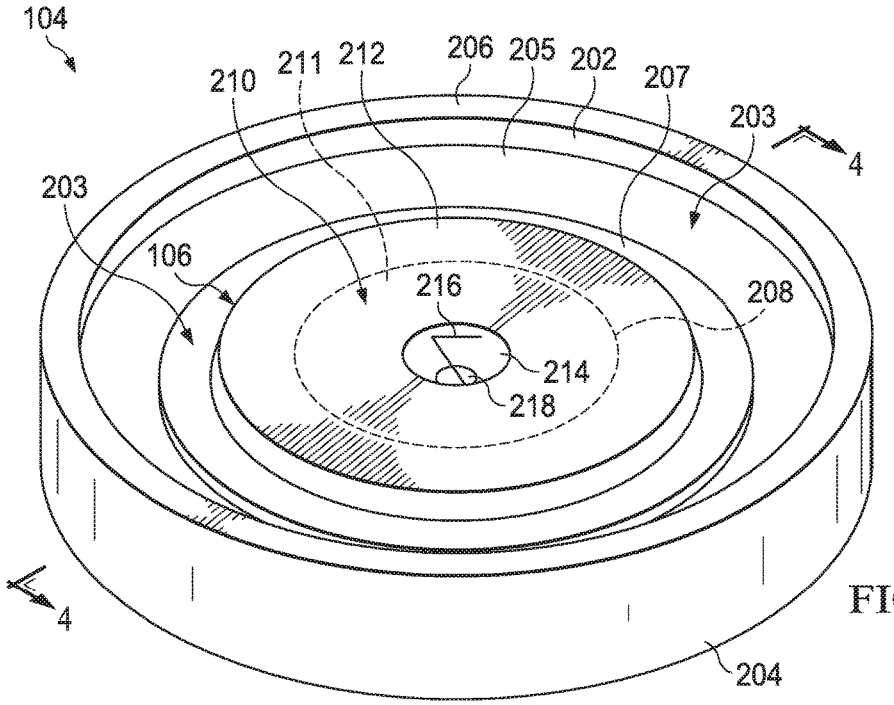
FIG. 2 is a top perspective view of the lid and the septum of the container of FIG. 1.

Turning to FIG. 2, there is illustrated a more detailed view of the top of lid 104 and the septum 106. The lid 104 includes central portion 203, a top surface 205, a bottom surface 209 (shown in FIGS. 3A and 3B), and a septum hole 211 defined by the central portion 203. In some embodiments, the lid 104 is made of nylon. Preferably, the lid 104 is made of a material that will not be affected by gamma radiation, which is often used to sterilize medical and medical testing equipment. In some embodiments, part of the central portion 203 is raised slightly from the rest of the central portion 203 to form raised portion 207. The lid 104 may have a vertical inner sidewall 202 and a vertical outer sidewall 204, with the outer sidewall 204 positioned concentrically outside of the inner sidewall 202. The outer edge of top surface 205 is connected to a vertical inner sidewall 202, which extends vertically from the outer edge of top surface 205 to a point above the outer edge of top surface 205. The top edges of inner sidewall 202 and outer sidewall 204 are connected to each other by a sidewall connecting portion 206, which forms a ring in the space between the top edges of inner sidewall 202 and outer sidewall 204. A gap 213 (shown in FIG. 4) is formed between the outer side of inner sidewall 202 and the inner side of outer sidewall 204 under sidewall connecting portion 206. In some embodiments, the joining of the top surface 205 and the inner sidewall 202 forms a right angle, while in other embodiments, the connection between top surface 205 and inner sidewall 202 is beveled or chamfered.

The septum hole 211 is defined by the inner edge 208 of central portion 203. In the embodiment shown, the septum hole 211 is roughly circular, but in other embodiments, the septum hole 211 may by an oval or even polygonal shape. The septum 106 is made of an elastomeric material such as silicone, which allows the septum to deform without breaking or tearing when up to a certain amount of force is exerted, and which also allows the septum 106 to return to its original shape when that force is removed. The septum 106 is preferably made of a material that will not be adversely affected by gamma radiation. The septum 106 is engaged with the lid 104 such that the septum 106 completely covers or blocks the septum hole 211. In the embodiment depicted, septum 106 includes a central septum portion 210 which extends from radially from the center of the lid 104 to the inner edge 208 and extends vertically from just above the top surface 205, through the septum hole 211, and to just below the bottom surface 209 of the lid 104. Septum 106 also has a top overlapping portion 212 which extends from the top edge of central septum portion 210 radially outward over the top surface 205 of the lid such that it overlaps a portion of central portion 203 of the lid 104. A similar overlapping portion covers part of the bottom surface 209 of the lid 104 and is depicted in FIG. 3. In some embodiments, the septum 106 is secured to the lid 104 with bonding of the central portion inner edge 208 to the portion of central septum portion 210 that passes through the septum hole 211. In a preferred embodiment, as shown in FIG. 2, the septum 106 is engaged with lid 104 via an interference fit between the central septum portion 210 and the inner edge 208 of central portion 203. In one embodiment, the septum 106 is first manufactured, and subsequently the lid 104 is then injection-molded around the already-manufactured septum 106 such that the lid inner edge 208 defining the septum hole 211 compresses the central septum portion 210 to create the interference fit between septum 106 and lid 104. Other methods of securing the septum 106 to cover the septum hole 211 include first fabricating the lid 104, then molding the septum 106 within the septum hole 211. In yet another method, both the lid 104 and the septum 106 are separately molded, then the septum is inserted into the hole 211.

The elastomeric septum 106 also has a depressed portion 214 in central septum portion 210. This depressed portion 214 is a portion of the septum 106 where the thickness of the elastomeric material is relatively thin compared to the average thickness of the septum and includes an area of minimum thickness 218, preferably in the center of the depressed portion 214. In other words, the distance from the top of the septum 106 to the bottom of the septum 106 is much less in the depressed portion 214 than it is in the rest of the central septum portion 210. The thickness of elastomeric material in septum 106 increases from the area of minimum thickness 218 over a distance transverse to the thickness. The depressed portion 214 and the area of minimum thickness 218 are shaped and configured to elastically distend and tear in the area of minimum thickness 218 to allow an implement to pass through septum 106 down into the chamber of the container 100 where the sample is located. Having a relatively thin region of elastomeric material at depressed portion 214 makes the septum material more easily pierced. As an implement, such as a sample probe or pipette is inserted into the area of minimum thickness 218 from above the lid 104, the septum 106 will begin to elastically distend. Eventually, when the implement has been inserted far enough into the septum 106, the elastomeric material will tear, allowing the implement to pass through. When the implement is withdrawn, the opposite edges of the tear return to a substantially closed condition.

In some embodiments, the depressed portion 214 has a score or pre-cut 216, which also allows for implements to more easily tear and pass through the area of minimum thickness 218 so that the sample within the container 100 can be reached by the implement. The pre-cut 216 reduces the force needed for the implement to push and tear through the septum 106. The pre-cut 216 provides a pre-defined break plane or break path where the septum 106 will most likely tear when force is applied by an implement and also improves how well the tear will reclose when the implement is withdrawn from septum 106. Although pre-cut 216 can extend vertically all the way through the area of minimum thickness 218, in a preferred embodiment, the pre-cut is starts on either the top or bottom side of the septum 106 and does not pass all the way through to the other side of the septum 106. This decreases the likelihood of spillage or leakage or the liquid sample as compared to a septum that has a pre-cut 216 all the way through septum 106. In a preferred embodiment, the depressed portion 214 is cone-shaped, such that radius of the depressed portion 214 is greatest on the top surface of septum 106 and gradually reduces as the distance to the bottom side of septum 106 is decreased. One advantage of a cone-shaped depressed portion 216 is that a probe being inserted, in a slightly off-center position, into the top of septum 106 through the depressed portion 216 will be guided towards the center by the angled sides of the depressed portion 216.

Figure 4:
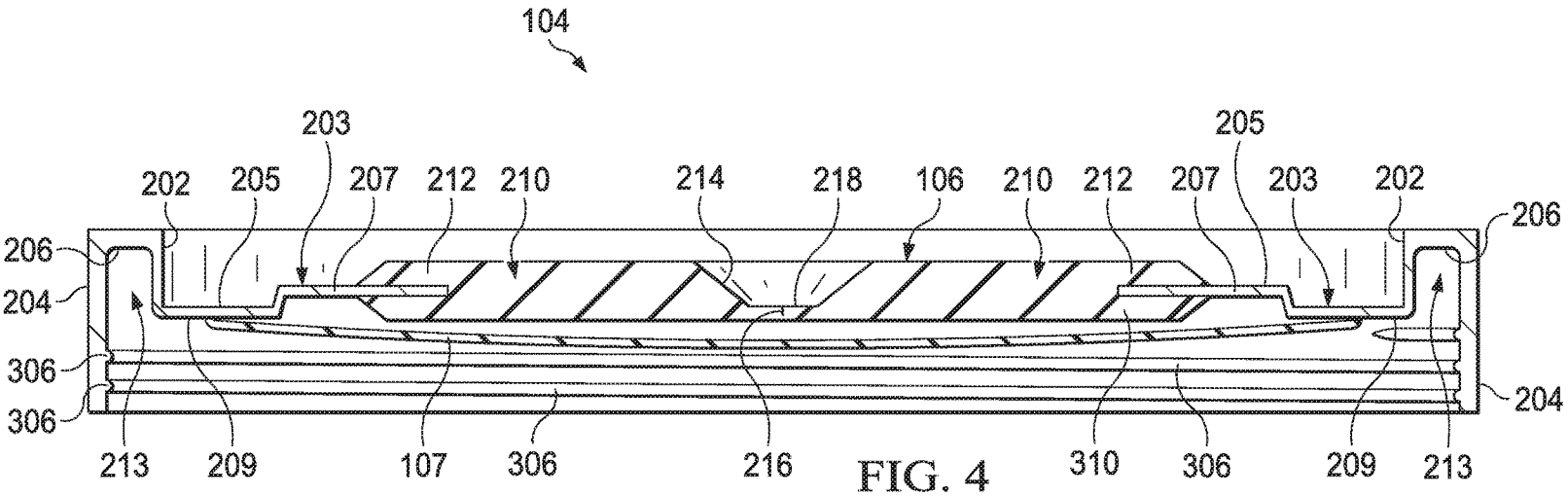
FIG. 4 is a cross-section view of the lid and the septum of FIGS. 2 and 3A and 3B in accordance with another aspect.

Referring now to FIGS. 3A, 3B, and 4, there is illustrated a lid 104 for a specimen container in accordance with another aspect. Turing first to FIG. 3A, there is illustrated a view of the bottom of lid 104. The bottom of lid 104 includes bottom surface 209 of central portion 203, which is on the opposite side of central portion 203 from the top surface 205. The inner sidewall 202 extends vertically along the edge of central portion 203 down from the top surface 205 to connect with bottom surface 209. In some embodiments, joint of inner sidewall 202 and bottom surface 209 forms a clean right angle, while in other embodiments, the joint is radiused. Visible in FIG. 3A is the bottom of the sidewall connecting portion 206, as well as the inside surface of outer sidewall 204 and the outer surface of inner sidewall 202. The outer sidewall 204 extends from the sidewall connecting portion vertically down past the bottom surface 209 of the central portion 203 until it ends at outer sidewall bottom edge 304. In this view, raised portion 207 is visible as the part of central portion 203 that if offset in the vertical direction toward the top surface 205 of lid 104. Lid threads 306 are on the inside surface of outer sidewall 204 and are adapted to engage complementary threads on the outside of cup 102 (shown in FIG. 5), such that the lid 104 can be secured to the cup 102 by screwing the lid 104 onto the top end 504 of the cup 102.

Regarding the septum 106, bottom overlapping portion 310 is visible extending from central septum portion 210 (which extends from a few millimeters below bottom surface 209, through septum hole 211, to a few millimeters above top surface 102) radially outward to overlap a portion of the bottom surface 209 of central portion 203. Also visible from the view of FIG. 3A is the pre-cut 216 in septum 106. In the embodiment depicted, the pre-cut is made from the top side of the septum 106 down towards, but not all of the way to, the bottom side of septum 106. However, if septum 106 is made of a transparent or translucent material, then the cut will still be visible from a bottom view of the lid 104, as is the case in the embodiment depicted.

Turning now to FIG. 3B and FIG. 4, there is depicted a view of the bottom of lid 104 and a cross-sectional view. It will be seen that the lid 104 has a non-porous seal 107 affixed to the bottom surface 209 of central portion 203 in accordance with another aspect. In a preferred embodiment, the outer portion of seal 107 is attached to the central portion 203 of lid 104 via heat-seal bonding, while in other embodiments, it is affixed via any other type of bonding, such as with an adhesive, that will not cause sample contamination or inaccurate sample readings. The non-porous seal 107 creates a liquid-tight boundary between the septum 106 and anything on the other side of the seal 107. In practice, when the lid 104 is affixed to the cup 102, the seal 107 creates a liquid-tight boundary between the septum 106 and the chamber within the container 100, thus preventing any liquid contents of container 100 from reaching the septum 106. This is useful, for example, in situations where an external or internal pressure change might otherwise (i.e., without the seal 107) force liquid from the chamber within container 100 out through the septum 106. Even if septum 106 includes a precut 216 that does not extend all the way through to both sides of septum 106, a large enough pressure differential could cause the septum 106 to tear and allow any enclosed specimen to leak out. The liquid-tight seal 107 helps prevent this problem by adding an additional protective barrier. In a preferred embodiment, the non-porous seal 107 is made of a thin metal foil, for example aluminum, but it may also be made of plastic, or plastic coated metal foil, or other material that is capable of creating a liquid-tight barrier and that can be easily pierced by a sampling probe. The non-porous seal 107 is preferably made of material that will not be damages by gamma radiation in doses typically used to sterilize medical testing equipment.

Figure 5:
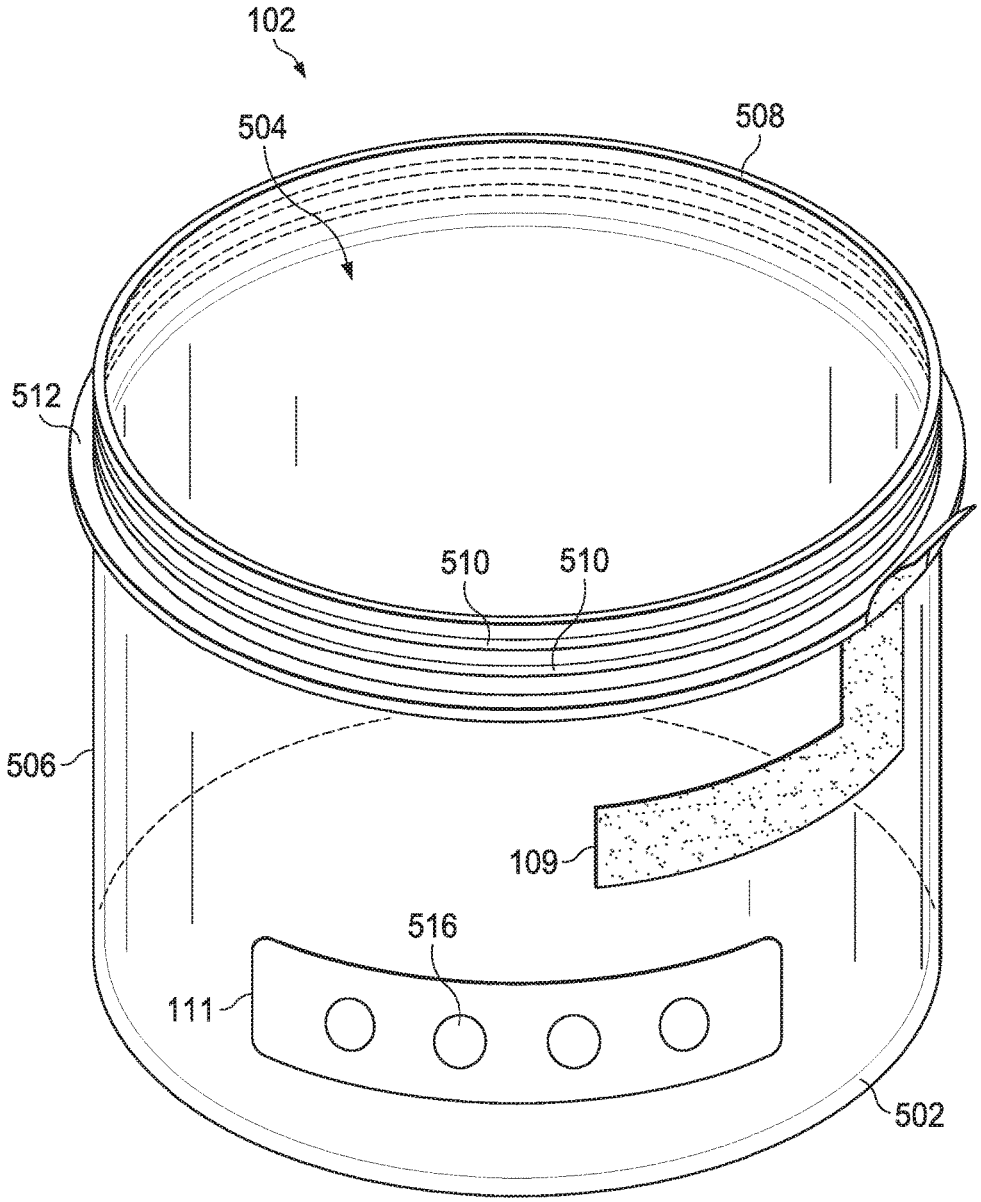
FIG. 5 is a view of the cup of FIG. 1.
Figure 6A:
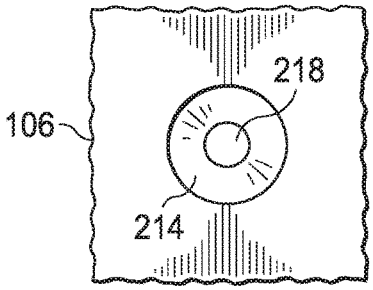
FIGS. 6A and 6B are, respectively, a partial top view and a corresponding partial cross-sectional view of an alternative embodiment of the septum showing the depressed portion.
Figure 6B:
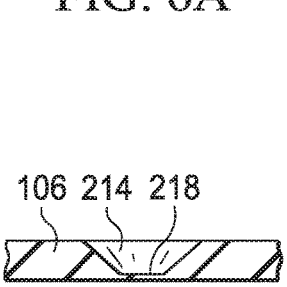

Turning to FIG. 5, there is illustrated the cup 102. In some embodiments, the cup 102 is made of plastic. Preferably, the cup 102 is made of material that will not be damaged by gamma radiation in doses typically used to sterilize medical testing equipment. As described hereinabove, the cup 102 is generally cylindrically shaped, with a closed bottom end 502 and an open top end 504, with the open top end 504 being defined by the top edge 508 of cup sidewall 506. Cup threads 510 are disposed on the exterior of cup sidewall 506 proximate to the top edge 508. The cup threads 510 are adapted to engage with lid threads 306 such that the lid 104 can be securely affixed to cup 102 by screwing lid 104 onto the top end 504 of cup 102. To help prevent the lid 104 from being screwed onto cup 102 too tightly (which could result in lid threads 306 or cup threads 510 breaking or being stripped, or even cup sidewall top edge 508 or lid sidewall connection portion 206 being deformed), cup sidewall ridge 512 is disposed on the exterior of the cup sidewall 506 slightly below and proximate to the cup threads 510. If the lid 104 is tightened beyond a certain point, the outer sidewall bottom edge 304 of the lid 104 will begin to press down on the ridge 512, such that further tightening of the lid 104 becomes more difficult.

Also affixed the exterior of the cup sidewall 506 is a temperature indicator label 111. The indicator label 111 has several indicator spots 516 which each change color from a default when the label is at a specific temperature or temperature range. Each spot 516 has the same default color, but changes from that default color at a different temperature. A spot 516 that has changed color will change back to the default color when the temperature of the indicator label 111 leaves that spot's 516 temperature range. In some embodiments, the temperature indicator label 111 is comprised of a paper or thin plastic sheet and is affixed to the exterior or cup sidewall 506 with an adhesive. The purpose of the temperature indicator label 111 is for an individual to be able to quickly determine the approximate temperature of the contents of the container 100. For example, if a urine or blood specimen is deposited by a patient into the container 100, a technician can check the indicator label 111 and be able to determine the temperature of the contents of the container 100. If the indicator label 111 indicates that the specimen is at or near human body temperature, then the technician can be more confident that the specimen actually came from that patient's body, rather than being a sample placed into the container from another source, fraudulently trying to pass off the sample as having come directly from the patient's body.

Cup 102 may also have a witness seal 109 affixed to the exterior of cup sidewall 506. The witness seal 109 is a thin sheet of paper or plastic that is affixed to the exterior of cup sidewall 506 proximate to the cut sidewall top edge 508. A portion of witness seal 109 is affixed to the exterior of cup sidewall 506 below the cup sidewall ridge 512, and a portion of the witness seal 109 extends above the cup sidewall ridge 512 to at least the cup threads 510. The portion of the seal 109 that extends above the ridge 512, however, is not affixed to the cup 102. Instead, after the container 100 components are manufactured, the container 100 is sterilized with heat and/or radiation such as gamma radiation. After the lid 104 is screwed onto cup 102, the part of sterility seal 109 that extends above the ridge 512 is then pressed onto the exterior of cup outer sidewall 204. An unbroken witness seal 109 affixed to both the cup 102 and the lid 104 indicates to patients and technicians that the lid 104 has not been removed from cup 102 since the sterilization procedure has occurred. In preferred embodiments, the seal 109 is made of material that is torn easily, thus, when a patient is to deposit a specimen in cup 102, he or she can easily unscrew the lid 104 from cup 102. The sterility seal 109 will tear, allowing the lid 104 to be removed, and the torn seal 109 will also indicate that the lid container 100 can no longer be assumed to be sterile.

Referring now to FIGS. 6, 9, 10, and 11, there are illustrated examples of several different embodiments of the depressed portion 214 and the area of minimum thickness 218 of septum 106. FIGS. 6A-B illustrate an embodiment whereby the depressed portion 214 and area of minimum thickness 218 form a truncated cone. FIG. 6A is a view from the top of lid 104, while FIG. 6B is a cross-section view of the same embodiment. FIGS. 9A and 9B represent a top view and a cross-section view, respectively, of a depressed portion 214 and area of minimum thickness 218 that form a truncated pyramid shape. FIGS. 10A and 10B represent a top view and a cross-section view, respectively, of a depressed portion 214 and area of minimum thickness 218 that form a conical shape. FIGS. 11A and 11B represent a top view and a cross-section view, respectively, of a depressed portion 214 and area of minimum thickness 218 that form a round dimple shape. Of course, the embodiments illustrated are only examples, as the depressed portion 214 and area of minimum thickness 218 could take a number of other forms.

Figure 7:
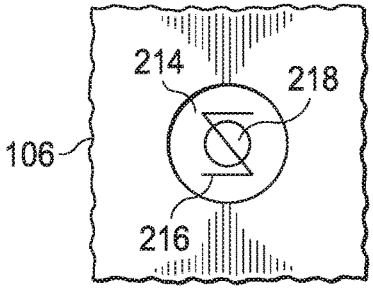
FIGS. 7, 12, 13, 14, and 15 are enlarged views of several septum depressed portions illustrating several different embodiments of the septum pre-cut.
Figure 9A:
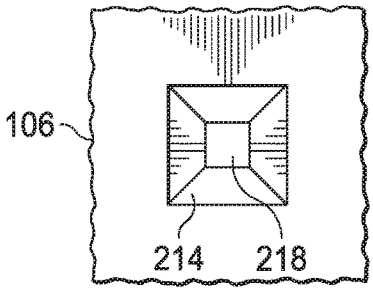
FIGS. 9A and 9B are, respectively, a partial top view and a corresponding partial cross-sectional view of another alternative embodiment of the septum showing the depressed portion.
Figure 9B:
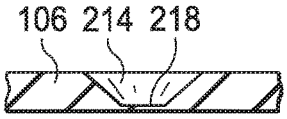
Figure 10A:
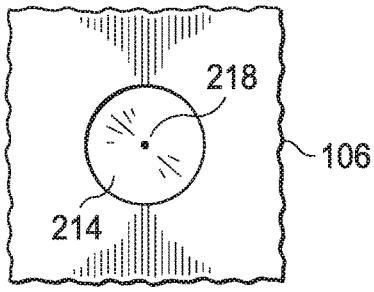
FIGS. 10A and 10B are, respectively, a partial top view and a corresponding partial cross-sectional view of yet another alternative embodiment of the septum showing the depressed portion.
Figure 10B:
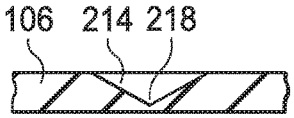

Referring now to FIGS. 7, 12, 13, 14, and 15, there are illustrated overhead views of several different embodiments of the pre-cut 216. Turning first to FIG. 7, there is illustrated on overhead view of an embodiment of pre-cut 216. This cut, sometimes called a "Z-cut" is shaped similar to the letter "Z" or "z" when looking onto the plane of the cut. It is created by making two substantially parallel cuts of approximately the same length, then creating a third cut from one end of one of the first two cuts to the opposite end of the second of the first two cuts. The Z-cut is a preferable embodiment of pre-cut 216 for a number of reasons. First, it allows an implement such as a pipette to pass through and tear the septum 106 relatively easily. This is important if the pipette being used is relatively soft and cannot exert a large amount of compressive force without bending or deforming, for example, if the implement is made out of a relatively soft plastic. Second, the Z-cut will not "grip" or "pull" a withdrawing implement as strongly as other cuts will. This is important, for example, when a machine is used to insert a pipette through the septum 106 to draw a specimen sample. If the tear in the septum 106 grips the pipette too hard as the pipette is being withdrawn from the container 100, then the pipette might be pulled off of the machine and remain stuck in the septum 106. Lastly, the Z-cut, will also substantially reclose when the implement is withdrawn, creating a good, if not impervious, barrier to prevent liquid specimen from splashing or leaking out of the container 100.

Figure 12:
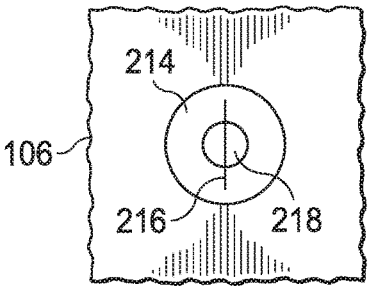
Figure 13:
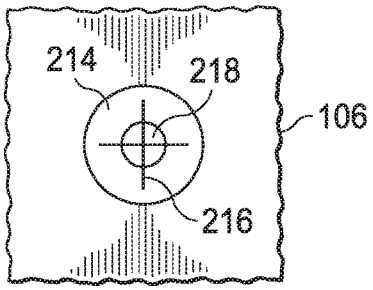
Figure 14:
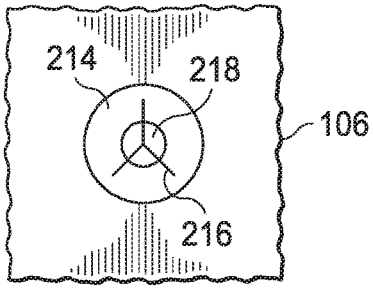
Figure 15:
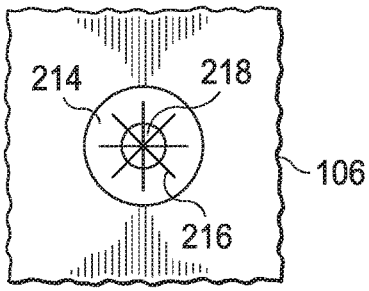

Other embodiments of pre-cut 216 are illustrated in FIGS. 12-15. FIG. 12 depicts a pre-cut 216 that is simply a single, straight cut. FIG. 13 depicts a pre-cut 216 made of two straight cuts, perpendicular to each other, that intersect in the center of each cut. FIG. 14 depicts a pre-cut 216 made of three straight cuts of equal length, all intersecting at a single point. The angle between each of the three cuts is approximately the same. Finally, FIG. 15 depicts a pre-cut 216 made of four straight cuts that intersect at one point. Each cut intersects the others at its center point. The angle between each of the cuts is approximately the same.

Figure 8:
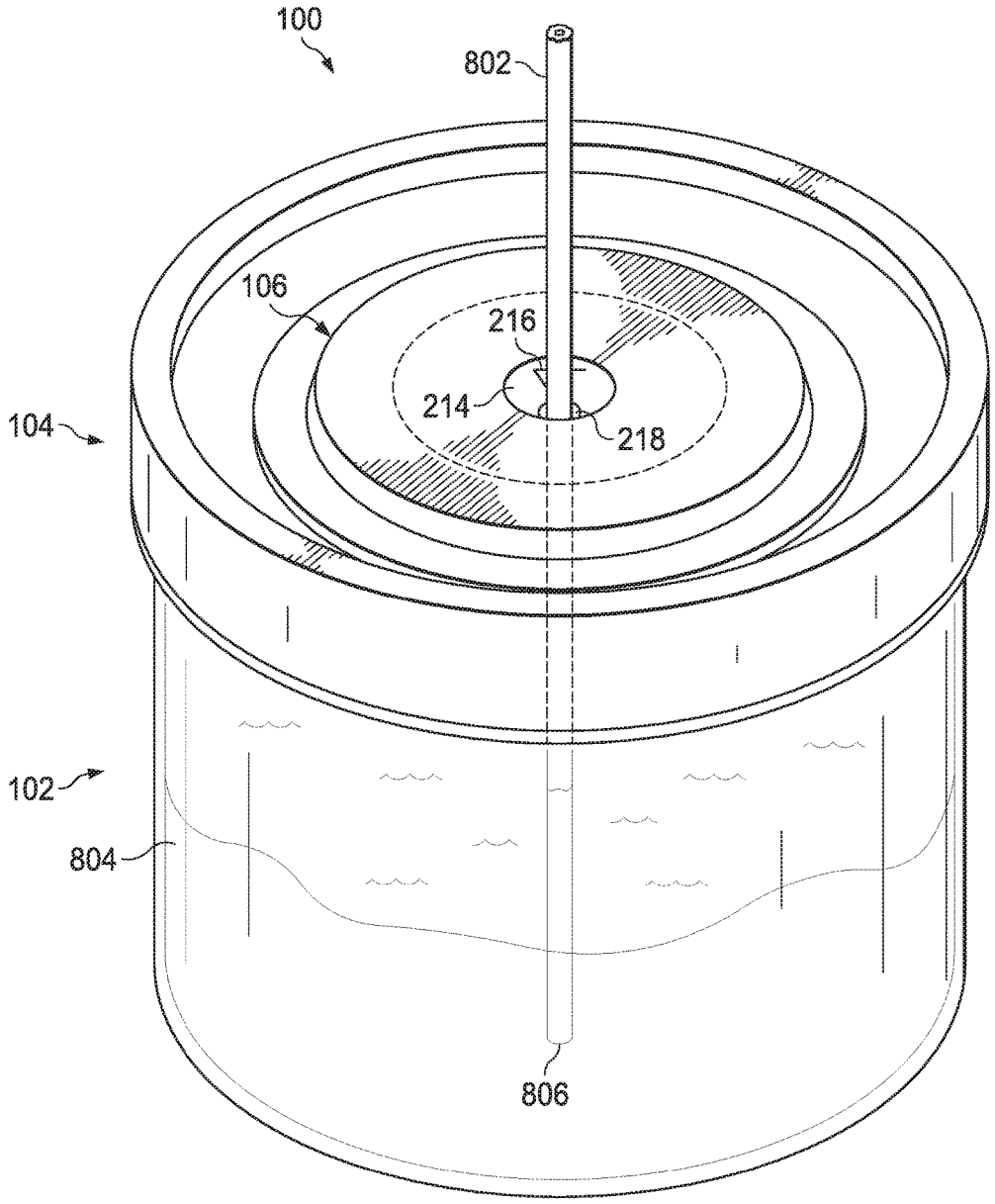
FIG. 8 illustrates an implement inserted through the septum and seal into the container to withdraw a liquid specimen sample.
Figure 11A:
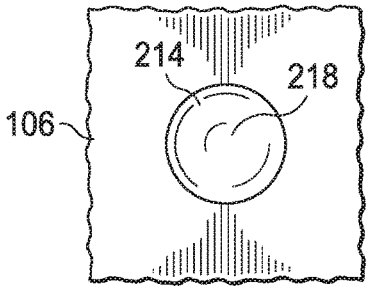
FIGS. 11A and 11B are, respectively, a partial top view and a corresponding partial cross-sectional view of still another alternative embodiment of the septum showing the depressed portion.
Figure 11B:
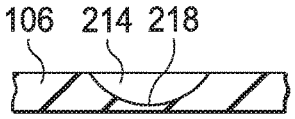

Turning to FIG. 8, there is illustrated an implement 802 collecting a sample of liquid specimen 804 from the cup 102 of container 100. As can be seen, an implement 802, such as a pipette, is inserted into septum 106 at the depressed portion 214. As downward force is applied to implement 802, implement 802 tears through septum 106 at the pre-cut 216. Once the tip 806 of implement 802 has passed through septum 106, it encounters the non-porous seal 107 (if present) on the bottom of the lid 104. As the force continues to push implement 802 downward, the tip 806 pierces and tears the seal 107 and passes through. The force pushes implement 802 down into the container 100 until the tip 806 of implement 802 is submerged in liquid specimen 804. A sample of liquid specimen 804 is then drawn into implement 802. Implement 802 is then pulled up out of the liquid specimen 804 and back out through the tear in septum 106 until it is completely clear of the container 100. Once implement 802 is completely clear of the septum 106, the tear in the septum 106 made by the implement 802 will close back together, creating a barrier that is reasonably liquid tight.

It will be appreciated by those skilled in the art having the benefit of this disclosure that this urine specimen bottle provides a liquid specimen container having a cup, a lid, a septum, and a non-porous seal. It should be understood that the drawings and detailed description herein are to be regarded in an illustrative rather than a restrictive manner, and are not intended to be limiting to the particular forms and examples disclosed. On the contrary, included are any further modifications, changes, rearrangements, substitutions, alternatives, design choices, and embodiments apparent to those of ordinary skill in the art, without departing from the spirit and scope hereof, as defined by the following claims. Thus, it is intended that the following claims be interpreted to embrace all such further modifications, changes, rearrangements, substitutions, alternatives, design choices, and embodiments.

What is claimed is:

1. A liquid specimen container for urine and other liquids comprising:
- a cup including:
  - a cylindrical sidewall with an upper edge and a lower edge,
  - a bottom wall attached to the lower edge, and the upper edge defining an open end;
- a container lid, the lid including:
  - a central portion with a top surface and a bottom surface, the central portion defining a septum hole formed through the top and bottom surfaces, and
  - cylindrical sidewalls;
- a septum of elastomeric material, the septum including:
- a top surface,
- a bottom surface,
- a depressed portion including an area of minimum thickness, the depressed portion increasing in thickness from the minimum thickness to much thicker elastomeric material, the increase in thickness occurring over a substantial distance along a direction transverse to the thickness, and
- a raised portion, including:
  - a flat central portion extending radially outward from the depressed portion and extending vertically from the top surface of the central portion of the container lid, and
  - a flat overlapping portion extending radially outward from a top edge of the flat central portion over a portion of the top surface of the central portion of the container lid;
- wherein the septum is connected to the container lid so as to completely block the septum hole, and wherein the depressed portion and said area of minimum thickness are shaped and configured to elastically distend to pass an implement through a tear in the area of minimum thickness and to be self-reclosing by returning opposite edges of the tear to a substantially contiguous closed condition after withdrawal of the implement;
- a non-porous seal affixed to the bottom surface of the central portion and having a top surface and a bottom surface, wherein the seal covers the bottom surface of the septum and creates a liquid-tight boundary between the septum and the bottom surface of the seal; and
- wherein the container lid is adapted to engage the open end of the cup and form a chamber within the cup between the bottom wall and the lid.

2. The liquid specimen container of claim 1, wherein the septum has a pre-cut that extends from the top surface of the septum at least partially through a portion of the area of minimum thickness.

3. The liquid specimen container of claim 1, wherein the septum has a pre-cut that extends from the top surface of the septum through a portion of the area of minimum thickness to the bottom surface of the septum.

4. The liquid specimen container of claim 2, wherein the pre-cut is a Z-cut shaped pre-cut.

5. The liquid specimen container of claim 1, further comprising a witness seal affixed to both the cup and the lid, wherein the witness seal is configured to break upon removal of the lid.

6. The liquid specimen container of claim 1, wherein the non-porous seal is heat-bonded to the bottom surface of the central portion of the container lid.

7. The liquid specimen container of claim 1, wherein the non-porous seal comprises a metallic foil.

8. A container cap for a container for urine and other liquids comprising:
- a container lid comprising:
  - a central portion with a top surface and a bottom surface, the central portion defining a septum hole formed through the top and bottom surfaces, and
  - cylindrical sidewalls;
- an elastomeric septum, the septum including:
- a top surface,
- a bottom surface, a depressed portion including an area of minimum thickness, the depressed portion increasing in thickness from the minimum thickness to much thicker elastomeric material, the increase in thickness occurring over a substantial distance along a direction transverse to the thickness, and a raised portion, including:

a flat central portion extending radially outward from the depressed portion and extending vertically from the top surface of the central portion of the container lid, and a flat overlapping portion extending radially outward from a top edge of the flat central portion over a portion of the top surface of the central portion of the container lid;

wherein the septum is connected to the container lid so as to completely block the septum hole, and wherein the depressed portion and said area of minimum thickness are shaped and configured to elastically distend to pass an implement through a tear in the area of minimum thickness and to be self-reclosing by returning opposite edges of the tear to a substantially contiguous closed condition after withdrawal of the implement;

a non-porous seal, having a top surface and a bottom surface, affixed to the bottom surface of the central portion of the lid, wherein the seal covers the bottom surface of the septum and creates a liquid-tight boundary between the septum and the bottom surface of the seal; and wherein the lid is adapted to engage an open end of a container cup and to form a chamber within the cup.

9. The container cap of claim 8, wherein the septum has a pre-cut that extends from the top surface of the septum at least partially through a portion of the area of minimum thickness.

10. The container cap of claim 8, wherein the septum has a pre-cut that extends from the top surface of the septum through a portion of the area of minimum thickness to the bottom surface of the septum.

11. The container cap of claim 8, wherein the non-porous seal comprises a metallic foil.

12. The container cap of claim 9, wherein the pre-cut is a Z-cut shaped pre-cut.

13. A method for producing a container cap for a container for urine and other liquids comprising the steps of:

fabricating a container lid, the lid including:

a central portion with a top surface and a bottom surface, the central portion defining a septum hole formed through the top and bottom surfaces, and cylindrical sidewalls;

fabricating a septum of elastomeric material, the septum including:

a top surface, a bottom surface, a depressed portion including an area of minimum thickness, the depressed portion increasing in thickness from the minimum thickness to much thicker elastomeric material, the increase in thickness occurring over a substantial distance along a direction transverse to the thickness, and a raised portion, including:

a flat central portion extending radially outward from the depressed portion and extending vertically from the top surface of the central portion of the container lid, and a flat overlapping portion extending radially outward from a top edge of the flat central portion over a portion of the top surface of the central portion of the container lid;

wherein the depressed portion and the area of minimum thickness are shaped and configured to elastically distend to pass an implement through a tear in the area of minimum thickness and to be self-reclosing by returning opposite edges of the tear to a substantially contiguous closed condition after withdrawal of the implement;

fabricating a non-porous seal;

positioning the septum so that the septum completely blocks the septum hole; and affixing the non-porous seal to the bottom surface of the central portion of the container lid so that the seal completely covers the bottom surface of the septum.

14. The method of claim 13, wherein the step of affixing the non-porous seal includes heat-bonding the non-porous seal to the bottom surface of the central portion of the container lid.

15. The method of claim 13, wherein the step of affixing the non-porous seal includes affixing the non-porous seal to the bottom surface of the central portion of the container lid with a chemical adhesive.

16. The method of claim 13 wherein the step of fabricating a container lid includes positioning the septum in an area defining the septum hole and injection-molding the container lid around the septum such that injection-molding the container lid positions the septum so that the septum completely blocks the septum hole.

17. The method of claim 13, wherein the step of fabricating a septum includes molding the septum within the septum hole such that molding the septum positions the septum so that the septum completely blocks the septum hole.

18. The method of claim 13, further comprising the step of creating, after fabricating the septum, a pre-cut in the septum that extends from the top surface of the septum at least partially through a portion of the area of minimum thickness.

19. The method of claim 18, wherein the step of creating a pre-cut in the septum includes creating a Z-cut shaped pre-cut.

20. The method of claim 13, further comprising the step of exposing the container lid, the septum, and the non-porous seal to gamma radiation.

* * * * *